US007971812B2

(12) United States Patent
Huang

(10) Patent No.: US 7,971,812 B2
(45) Date of Patent: Jul. 5, 2011

(54) POWER SAVING SHREDDER

(75) Inventor: Simon Huang, SanChung (TW)

(73) Assignee: Michilin Prosperity Co., Ltd., Taipei Hsien (TW)

( * ) Notice: Subject to any disclaimer, the term of this patent is extended or adjusted under 35 U.S.C. 154(b) by 0 days.

(21) Appl. No.: 12/485,453

(22) Filed: Jun. 16, 2009

(65) Prior Publication Data

US 2010/0059612 A1 Mar. 11, 2010

Related U.S. Application Data

(60) Provisional application No. 61/061,950, filed on Jun. 16, 2008, provisional application No. 61/104,058, filed on Oct. 9, 2008.

(51) Int. Cl.
*B02C 25/00* (2006.01)

(52) U.S. Cl. ..... 241/36

(58) Field of Classification Search ..... 241/36, 241/236, 100, 37.5

See application file for complete search history.

(56) References Cited

U.S. PATENT DOCUMENTS

| | | | | |
|---|---|---|---|---|
| 3,956,606 | A | 5/1976 | Reiter | |
| 4,270,856 | A | 6/1981 | Goida | |
| 4,469,124 | A | 9/1984 | Bronsky et al. | |
| 4,768,432 | A | 9/1988 | Storlie | |
| 4,787,212 | A | 11/1988 | Hessey | |
| 4,828,188 | A | 5/1989 | Snyder | |
| 5,042,790 | A | 8/1991 | Miller et al. | |
| 5,167,374 | A | 12/1992 | Strohmeyer et al. | |
| 5,561,356 | A | 10/1996 | Nanos | |
| 5,665,974 | A | 9/1997 | Truong | |
| 5,775,605 | A | 7/1998 | Tsai et al. | |
| 5,821,488 | A | 10/1998 | Falcon | |
| 5,917,405 | A | 6/1999 | Joao | |
| 5,984,215 | A | 11/1999 | Huang | |
| 6,059,536 | A | 5/2000 | Stingl | |
| 6,346,796 | B1 | 2/2002 | Takeda | |
| 6,542,076 | B1 | 4/2003 | Joao | |
| 6,542,077 | B2 | 4/2003 | Joao | |
| 6,549,130 | B1 | 4/2003 | Joao | |
| 6,587,046 | B2 | 7/2003 | Joao | |
| 6,802,465 | B1 * | 10/2004 | Norcott et al. | 241/36 |
| 6,827,300 | B2 | 12/2004 | Lee | |
| 7,134,088 | B2 | 11/2006 | Larsen | |
| 7,156,330 | B1 | 1/2007 | Lo | |
| 7,277,010 | B2 | 10/2007 | Joao | |
| 2007/0125892 | A1 | 6/2007 | Chen | |
| 2007/0164135 | A1 | 7/2007 | Zhong | |
| 2007/0246582 | A1 | 10/2007 | Aries et al. | |
| 2007/0267525 | A1 * | 11/2007 | Wang | 241/7 |
| 2007/0290083 | A1 | 12/2007 | Abramson et al. | |
| 2008/0080625 | A1 | 4/2008 | Miyata | |

* cited by examiner

*Primary Examiner* — Mark Rosenbaum
(74) *Attorney, Agent, or Firm* — Venable LLP; Stefan J. Kirchanski

(57) ABSTRACT

The present invention discloses a shredder which does not waste energy in standby mode. Power is applied to the components of the shredder only when material to be shredded is inserted into the shredder throat or when the unit is switched into reverse to clear a jam in the shredder.

4 Claims, 7 Drawing Sheets

Fisure 2

POWER SAVING SHREDDER

CLAIM OF PRIORITY

This application claims the benefit of U.S. Provisional Application Ser. No. 61/061,950, filed Jun. 16, 2008, and U.S. Provisional Application Ser. No. 61/104,058, filed Oct. 9, 2008, both of which are incorporated herein by reference.

BACKGROUND OF THE INVENTION

1. Area of the Art

The present invention relates generally to power saving mechanisms for shredders. Specifically, this invention discloses a shredder which uses energy only when paper is being shredded or in order to clear a jam in the shredder.

2. Description of the Background Art

With increased privacy concerns shredders have become an integral item in both homes and businesses. Though originally used to destroy paper products, shredders now are used for other forms of media that hold information, such as compact discs. In addition, credit cards and other plastic products are commonly shredded.

Shredders are typically left plugged into an outlet, oftentimes with the auto/off/reverse switch in the auto position because the user either forgets to turn off the power or chooses to leave the shredder on for convenience. In this standby setting, the shredder continues to consume power even though it is not in use. For example, certain shredders have components, such as photodetectors, LED indicators, and/or protection circuits, which draw current even in standby mode. A shredder can consume up to two watts per hour or 48 watts per day in the standby mode. In light of the increasing number of shredders in use, the amount of wasted energy is not insignificant.

In order to reduce power consumption, the present invention uses a micro-switch to turn on the shredder when material is inserted into the shredder throat, and then completely shut off all power after the material has been shredded.

In addition, the present invention ensures that the shredder motor always runs when reverse mode is engaged in order to clear jams in the shredder. This improvement is necessary to handle those situations where a jam occurs after the material has passed through the shredder throat. In such circumstances, since there is no material in the shredder throat to activate the micro-switch, the disclosed mechanism turns the motor on whenever the user switches the shredder to reverse.

From the preceding descriptions, it is apparent that the devices currently being used have significant disadvantages and/or limitations. Thus, important aspects of the technology used in the field of invention remain amenable to useful refinement.

SUMMARY OF THE INVENTION

The present invention relates to an apparatus that satisfies the need for a mechanism which consumes energy only when material is actually being shredded or to clear a jam in the shredder.

In one preferred embodiment, a power saving mechanism in a shredder having features of the present invention comprises a micro-switch which is activated when material to be shredded is inserted into the shredder throat. When the micro-switch is activated, the shredder and shredder motor turn on. Once the material passes through the throat and the shredding mechanism, the shredder turns completely off. It will be apparent to one of skill in the art that the shredder motor will coast briefly after power is cut off, thereby ensuring that the material being shredded clears the mechanism. A slight delay can also be built in to ensure all the material is shredded. While the shredder is off, it draws no current.

Shredders also have a reverse mode in case of a paper or other material jam. In some instances, the jam occurs after the material has already passed through the throat. Since there is no material in the throat to activate the micro-switch, it remains turned off. In order to accommodate such a situation, when the power switch is set to reverse, it engages a member which directly activates the micro-switch, thus turning on power for the shredder and shredder motor. In another embodiment, engaging a member to activate the micro-switch is not necessary to power the reverse mode. Instead, the shredder is configured such that it automatically turns on when reverse mode is engaged.

All of the foregoing operational principles and advantages of the present invention will be more fully appreciated upon consideration of the following detailed description with reference to the drawings.

DETAILED DESCRIPTION OF THE INVENTION

The following description is provided to enable any person skilled in the art to make and use the invention and sets forth the best modes contemplated by the inventor of carrying out his invention.

This invention discloses a paper or media shredder which automatically turns on when material is inserted into the throat and then shuts off all power after the material has been shredded.

The essential elements of a shredder are comprised of a base, a housing, and a shredding mechanism. The base, housing, and shredding mechanism can be of any sort commonly known to those skilled in the art and are thus not described herein.

Figure 1:
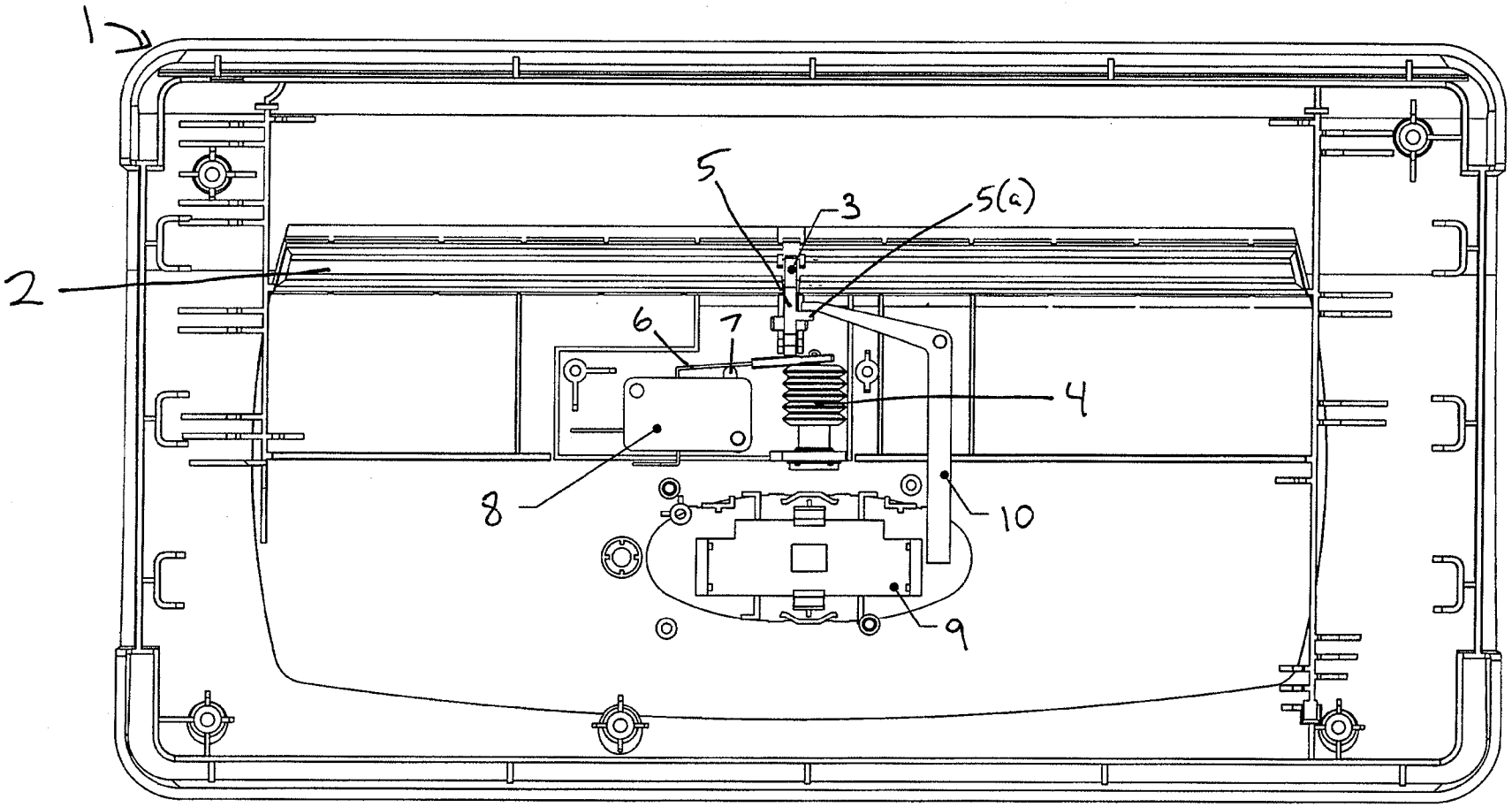
FIG. 1 is a bottom plan view of an apparatus embodying features of this invention.

FIG. 1 is a bottom view of the upper part of the housing 1. A switch 9 is provided to turn the shredder off (center position) or to set the shredder to "automatic" or reverse mode. Material to be shredded passes through the shredder throat 2. The shredder throat 2 is an opening that guides the material to be shredded into the cutting blades of the shredding mechanism. Towards the bottom of the shredder throat and extending across the opening of the throat is a finger 3. The finger 3 is biased by a spring 4 such that it extends across the shredder throat 2.

When material is inserted into the throat and presses against the finger 3, the finger 3 rotates around a joint allowing the material to pass. As the finger 3 rotates, it forces a rod 5 to depress a lever 6. The lever 6, then activates a button 7 on the micro-switch 8. If the shredder is in automatic mode, when the micro-switch 8 is activated (closed), the shredder and shredder motor turn on. While the material to be shredded is in the shredder throat 2, it maintains pressure against the finger 3 and the micro-switch remains activated, and thus the shredder components and shredder motor remain powered.

Once the shredded material passes, the spring 4 forces the lever 6 to disengage the micro-switch button 7 and the finger 3 moves back across the shredder throat 2. The shredder and shredder motor then turn completely off. There is a brief delay before the shredder and shredder motor are turned completely off in order to ensure that the shredded material passes through the shredding mechanism. The delay may be due to inertia of the mechanical parts or there may be an actual delay circuit that maintains electric power for a preset amount of time.

Figure 2:
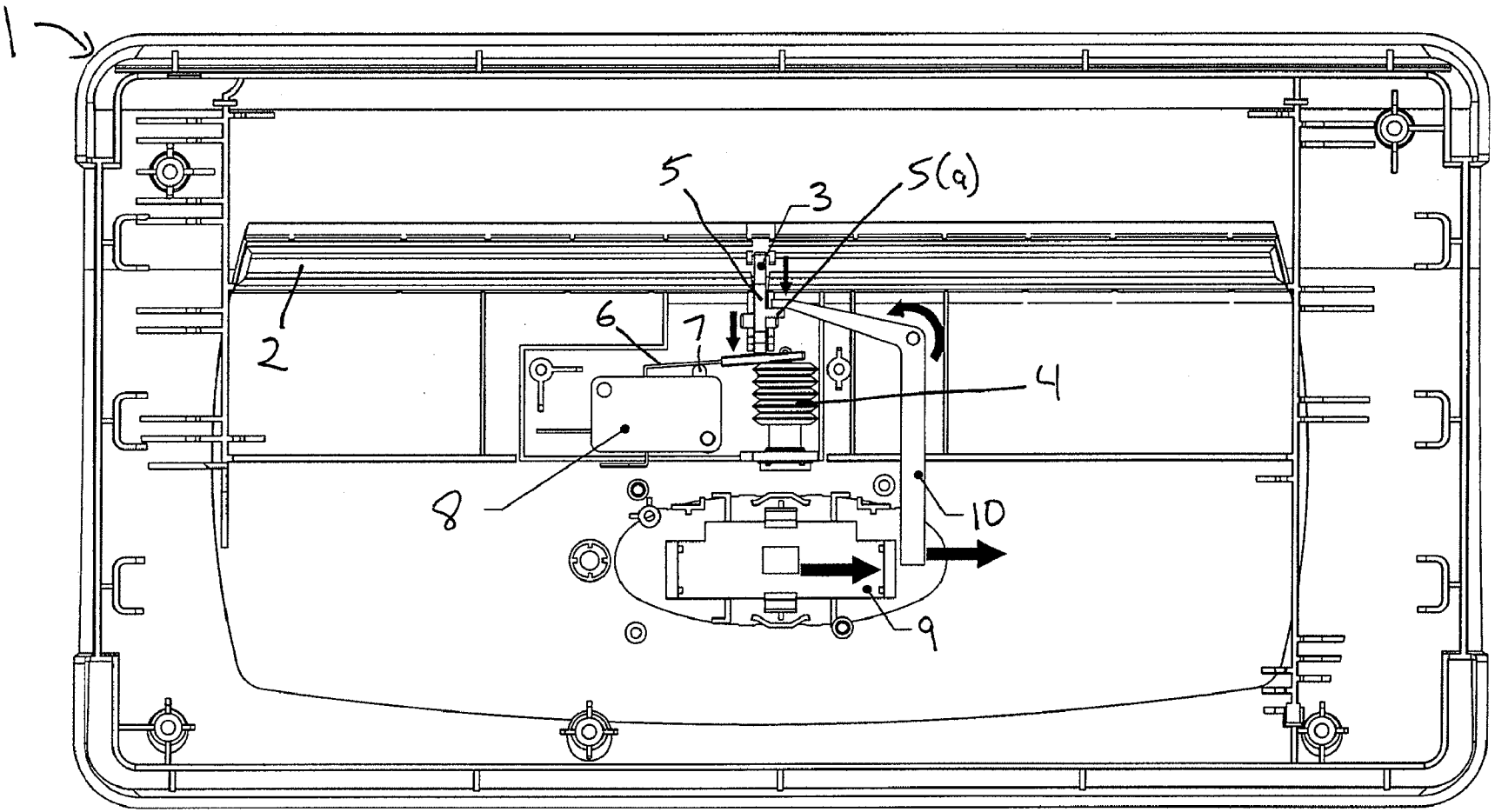
FIG. 2 is a bottom plan view of an apparatus embodying features of this invention.

Shredders also have a reverse mode in order to alleviate jams in the shredder. In some instances, the jam may occur after the material has passed by the finger 3. In order to accommodate these situations, the switch 9 is coupled to a member 10, such that when the reverse mode is engaged (by means of a switch 9), the member 10 rotates around a joint and presses against an appendage 5(*a*) on the rod 5. The rod 5 then presses against the lever 6 which activates the button 7 of the micro-switch 8. See FIG. 2. Once the micro-switch 8 is activated, the shredder components and shredder motor turn on. When the switch 9 is in the off position, the spring 4 forces the lever 6 to release the button 7 on the micro-switch 8, and the shredder components and shredder motor turn completely off.

Figure 3:
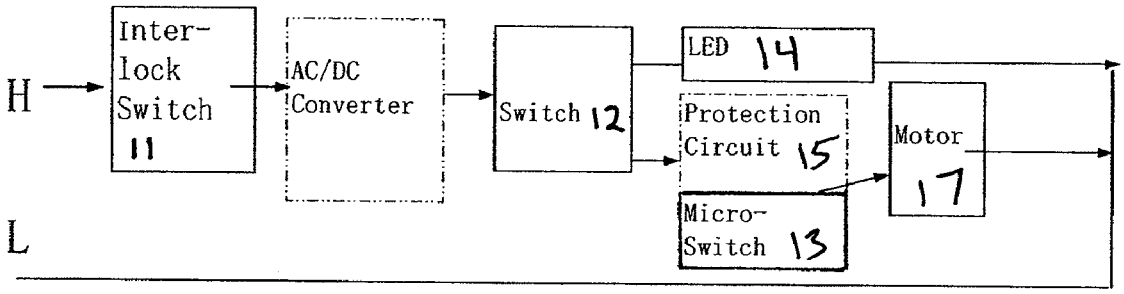
FIG. 3 is a logic flow chart embodying features of the prior art.

FIG. 3 is a logic flow chart of the prior art. Shredders generally have an interlock switch in the shredder housing to ensure that the shredder housing is properly connected to the base. On the top of the shedder housing is a switch having "automatic," "off," and "reverse" positions. In addition, prior art shredders have a micro-switch which detects the presence of material to be shredded in the shredder throat. When the shredder is on, an LED lights up. Depending on the type of motor, an AC/DC converter may be necessary. Also, most shredders have a protection circuit 15 (See hatched area of FIG. 4) for detecting whether the shredder base is full or whether the shredder motor has overloaded.

In order for material to be shredded, the housing has to be secure on the shredder base. When the housing is secure, the interlock switch 11 becomes activated. When the switch 12 is in the "automatic position," the shredder is in standby mode. In standby mode, shredder components, such as the LED 14 and protection circuit 15, continually draw power, even when the shredder motor is not turned on. When the micro-switch 13 is activated by material in the shredder throat, the shredder motor turns on.

Figure 4:
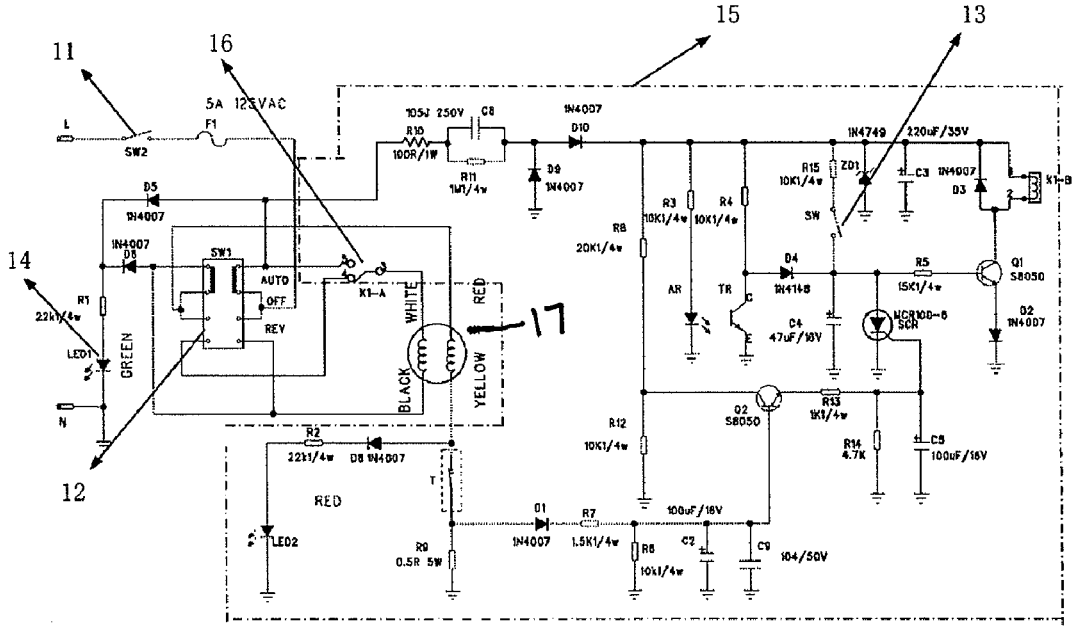
FIG. 4 is a schematic diagram of the power circuit for an apparatus embodying features of the prior art.

FIG. 4 is a schematic diagram of the prior art power circuit. The principles behind and operation of the circuit are readily understood by those skilled in the art. When the shredder housing is secure to the base, the interlock switch 11 closes. When material is inserted into the throat, the micro-switch 13 closes, which causes the relay 16 to close and the motor 17 to run. The motor 17 is able to run in reverse when the interlock switch 11 is closed and the switch is set in the "reverse" position. In the prior art device, certain shredder components continually draw power in stand by mode; even when the shredder motor is not running.

Figure 5:
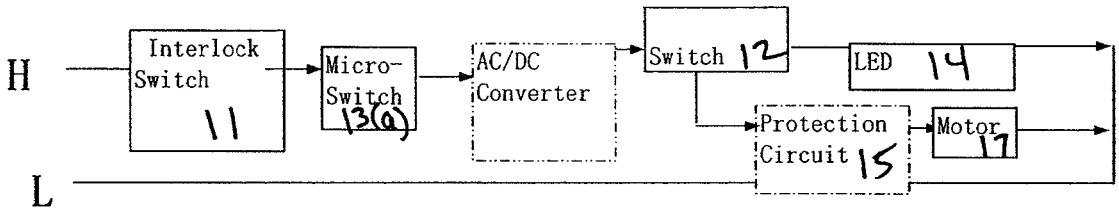
FIG. 5 is a logic flow chart embodying features of the present invention.

FIG. 5 is a logic flow chart of a power saving shredder. As the chart indicates, power can only be used after the interlock switch and micro-switch are both engaged. When material to be shredded is inserted into the throat, the micro-switch becomes activated. If the switch is in the "automatic position," shredder components such as the LED 14 and protection circuit 15 (hatched area of FIG. 6), as well as, the shredder motor receive power. If the micro-switch is not activated, all components of the shredder, including the shredder motor, receive no power.

Energy is used in the "reverse mode" when the switch closes the micro-switch as detailed above, and the interlock switch is closed.

Figure 6:
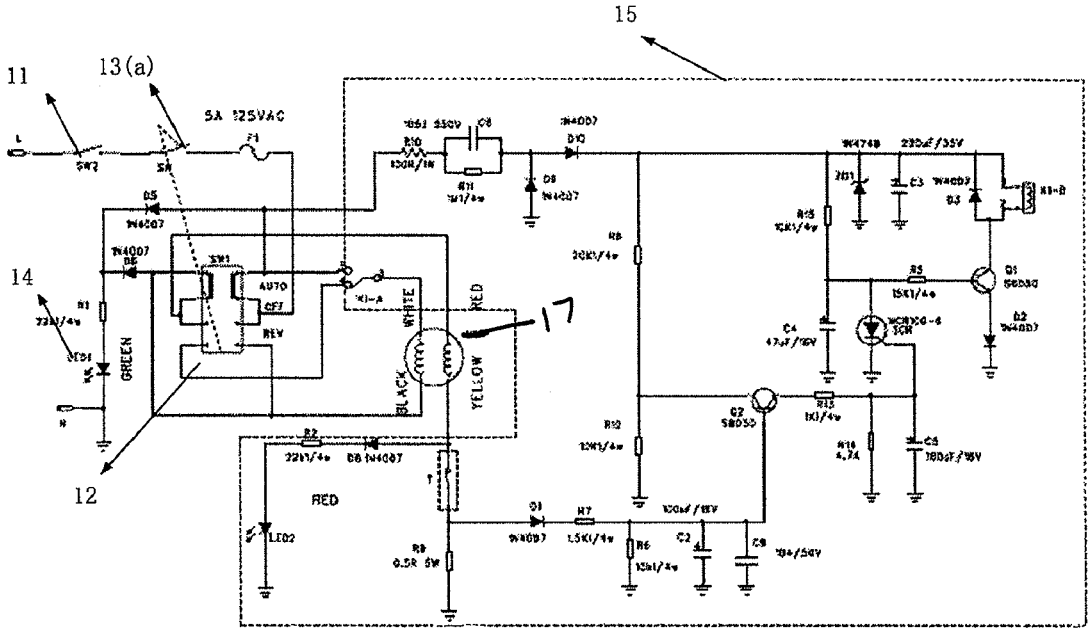
FIG. 6 is a schematic diagram of the power circuit for an apparatus embodying features of this invention.

As seen in FIGS. 5 and 6, the shredder uses energy only when the interlock 11 and micro-switch 13(*a*) are closed. This can only occur when the shredder housing is properly lodged on the base and one of the following occurs: (1) material in the shredder throat closes the micro-switch 13(*a*) or (2) the switch 12 is set in reverse thus closing the micro-switch 13(*a*). Such a configuration eliminates the waste of energy when the shredder is in stand-by mode.

In another preferred embodiment, engagement of a member is not necessary to power the reverse mode. Instead, the shredder is configured so that it automatically turns on whenever the "reverse" mode is engaged.

Figure 7:
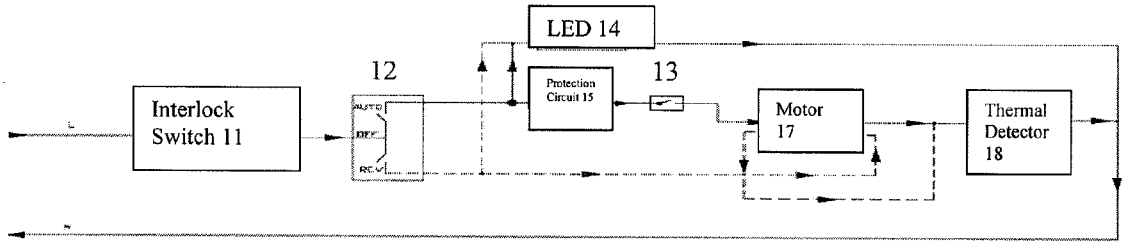
FIG. 7 is a logic flow chart embodying features of the prior art.

FIG. 7 is a logic flow chart of the prior art. As detailed above, when the shredder is in "standby mode," both the LED 14 and protection circuit 15 draw power, irrespective of whether material is being shredded. When material to be shredded activates the micro-switch 13 the shredder motor 17 then turns on. A thermal detector 18 is also activated to monitor the temperature of the shredder motor 17 and turn it off if the motor 17 overheats. For the "reverse" mode, the shredder is configured so that the LED 14, protection circuit 15, shredder motor 17, and thermal detector 18 receive power whenever the shredder is in "reverse".

Figure 8:
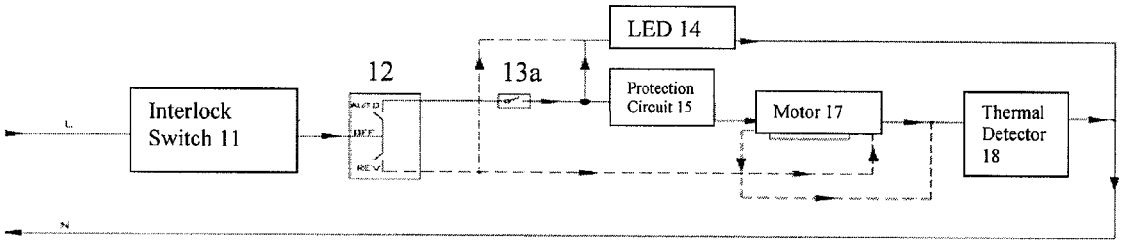
FIG. 8 is a logic flow chart embodying features of the present invention.

FIG. 8 discloses a preferred embodiment whereby a shredder is configured so that in the "standby" mode, the micro-switch 13(*a*) must be activated before all shredder components receive power. That is, the LED 14, protection circuit 15, shredder motor 17, and thermal detector 18 turn "on" (receive power) when the shredder is in "standby" mode and the micro-switch 13(*a*) has been activated.

For the "reverse" mode, engagement of a member by the switch 12 is not necessary as disclosed in the earlier embodiment. Instead, the shredder is configured so that the LED 14, protection circuit 15, shredder motor 17, and thermal detector 18 receive power whenever the shredder is in "reverse" mode. That is, the switch 12 is wired so that when the switch 12 is in the "reverse" position, power is directly applied to the motor 17, LED 15, protection circuit 16 and thermal detector 18. The "reverse" position on the switch 12 may be spring loaded so that the switch 12 cannot be left in that position. Instead, the user must hold the switch 12 in the "reverse" position whenever it is necessary to reverse the motor 17.

Figure 9:
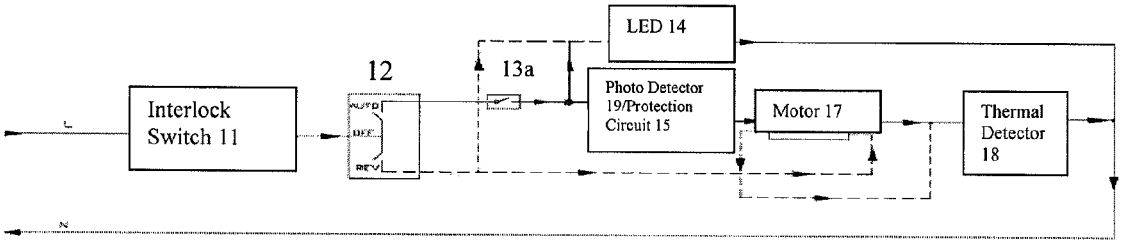
FIG. 9 is a logic flow chart embodying features of the present invention.

FIG. 9 discloses another preferred embodiment, adding a photodetector 19 to the embodiment disclosed in FIG. 8. In the prior art devices, a photodetector 19 is located at the end of the throat, above the cutting mechanism. The photodetector 19 turns the shredder motor 17 on once it detects shredded material. In order for the photodetector 19 to function, it must draw power in "standby" mode.

In this preferred embodiment, the photodetector 19 (as well as all other shredder components) can only consume power after the micro-switch 13(*a*) is activated. The micro-switch 13(*a*) includes a delay circuit to ensure that the shredder components remain on after the micro-switch 13(*a*) is disengaged. This delay in the micro-switch 13(*a*) allows for the shredder components (LED 14, photodetector 19, protection circuit 15) to remain on during the period of time after a piece of material is shredded, and before the next piece of material activates the micro-switch 13(*a*). The photodetector 19 also has a built in delay to ensure that the material that passes by it is shredded by the shredder motor 17. This configuration thus allows the delay in the shredder motor 17 to be set at one interval, while the delay for other shredder components can be set at a different interval. For example, the delay in the photodetector 19 can be set such that the shredder motor 17 turns off as soon as a piece of material is shredded, while the delay in the micro-switch 13(*a*) keeps the other shredder components powered up during the period of time after the material has been shredded and before the next piece of material is inserted, thereby avoiding the repeated powering up and powering down of the electrical components.

And, as in the prior embodiment disclosed in FIG. 8, the shredder is configured so that the LED 14, motor 17, and thermal detector 18 turn on when the shredder is in "reverse" mode.

It should be appreciated that although this preferred embodiment has a delay built into the micro-switch and photodetector, the delay in either the micro-switch and/or the photodetector is not necessary. In addition, although this preferred embodiment has different delays built into the micro-switch and photodetector, the same delay time can be built into the micro-switch and photodetector.

Although the present invention has been described in detail with respect to certain preferred versions thereof, other versions are possible. Therefore, the scope of the claims should not be limited to the description of the preferred versions contained herein.

I claim:

1. A power saving shredder comprising;

a base;

a housing;

a shredding mechanism inside the housing including power consuming shredder components and a power consuming shredder motor;

a switch on the housing for selecting one of off, automatic and reverse modes;

a throat that guides material to be shredded into the shredding mechanism;

a finger biased to extend into in the throat so that material to be shredded displaces the finger to pass into said shredding mechanism;

a rod which depresses a lever when the finger is displaced, wherein the lever activates a button in a micro-switch such that when automatic mode is selected and the micro-switch is activated, the shredder components and shredder motor are turned on, and when the micro-switch is not activated the shredder components and the shredder motor are turned off.

2. The power saving shredder of claim 1, wherein the switch on the housing is coupled to a member such that when reverse mode is selected, the member activates the micro-switch.

3. A power saving shredder comprising;

a base;

a housing;

a shredding mechanism inside the housing including power consuming shredder components and a power consuming shredder motor;

a throat that guides material to be shredded into said shredding mechanism;

a switch for selecting one of off, automatic or reverse modes wherein if the switch is set to reverse mode both said shredder components and said shredder motor receive power and the shredder motor runs in reverse; and a micro-switch in the throat that turns on power to said shredder components and said shredder motor only when the material to be shredded activates the micro-switch and the switch is set to automatic mode; and turns off power to said shredder components and said shredder motor when the micro-switch is not activated.

4. A power saving shredder comprising;

a base;

a housing;

a shredding mechanism inside the housing including power consuming shredder components and a power consuming shredder motor;

a throat that guides material to be shredded into said shredding mechanism;

a switch for selecting one of off, automatic or reverse modes wherein if the switch is set to reverse mode both said shredder components and said shredder motor receive power and the shredder motor runs in reverse;

a micro-switch in the throat that turns on power to said shredder components and said shredder motor only when the material to be shredded activates the micro-switch and the switch is set to automatic mode; and turns off power to said shredder components when the micro-switch is not activated, wherein the micro-switch has a delay circuit providing a first delay to ensure that said shredder components remain on after the micro-switch is disengaged; and a photodetector included in said shredder components which activates the shredder motor; wherein the photodetector has a built in delay providing a second delay to ensure that the material that passes by the photodetector is completely shredded and wherein the first delay is longer than the second delay to avoid repeatedly powering said shredder components up and down.

* * * * *